US011795865B2

(12) United States Patent
Lin et al.

(10) Patent No.: US 11,795,865 B2
(45) Date of Patent: Oct. 24, 2023

(54) WARM-UP METHOD BASED ON TEMPERATURE CONTROL MODULE, VEHICLE, AND STORAGE MEDIUM

(71) Applicant: GUANGZHOU AUTOMOBILE GROUP CO., LTD., Guangzhou (CN)

(72) Inventors: Chengbo Lin, Guangzhou (CN); Xinlin Duan, Guangzhou (CN); Guangquan Wu, Guangzhou (CN)

(73) Assignee: GUANGZHOU AUTOMOBILE GROUP CO., LTD., Guangdong (CN)

( * ) Notice: Subject to any disclaimer, the term of this patent is extended or adjusted under 35 U.S.C. 154(b) by 0 days.

(21) Appl. No.: 17/756,733

(22) PCT Filed: Jun. 3, 2021

(86) PCT No.: PCT/CN2021/098213
§ 371 (c)(1),
(2) Date: Jun. 1, 2022

(87) PCT Pub. No.: WO2021/254165
PCT Pub. Date: Dec. 23, 2021

(65) Prior Publication Data

US 2023/0010428 A1 Jan. 12, 2023

(30) Foreign Application Priority Data

Jun. 18, 2020 (CN) ..... 202010559771.x

(51) Int. Cl.
*F01P 11/14* (2006.01)
*F01P 7/16* (2006.01)
*F01P 7/14* (2006.01)

(52) U.S. Cl.
CPC ..... *F01P 7/167* (2013.01); *F01P 11/14* (2013.01); *F01P 2007/146* (2013.01);
(Continued)

(58) Field of Classification Search
CPC ..... F01P 7/167; F01P 7/14; F01P 2025/08
See application file for complete search history.

(56) References Cited

U.S. PATENT DOCUMENTS 6,067,959 A * 5/2000 Fassler ..... F02D 41/068 123/142.5 R
6,279,390 B1 * 8/2001 Oka ..... F01P 11/16 73/114.68
(Continued)

FOREIGN PATENT DOCUMENTS

CN 106246328 A 12/2016
CN 106321214 A 1/2017
(Continued)

OTHER PUBLICATIONS

English Translation of Search Report issued to Foreign Patent Application No. PCT/CN2021/098213 dated Aug. 26, 2021.
(Continued)

*Primary Examiner* — Long T Tran
(74) *Attorney, Agent, or Firm* — Hodgson Russ LLP

(57) ABSTRACT

A warm-up method based on a temperature control module, a vehicle, and a storage medium. The warm-up method based on the temperature control module comprises: entering a cold start mode; obtaining current temperature control parameters, the temperature control parameters comprising a current water temperature value, a current engine speed, and a current engine load; obtaining working parameters of a temperature control module according to the temperature control parameters; controlling the temperature control module according to the working parameters to adjust the water temperature to warm an engine, and updating the current water temperature value; and after the updated current water temperature value does not exceed a warm-up
(Continued)

threshold, returning to the step of obtaining the current temperature control parameters to enter the next cycle.

21 Claims, 5 Drawing Sheets

(52) U.S. Cl.
CPC ..... *F01P 2025/08* (2013.01); *F01P 2025/62* (2013.01); *F01P 2025/64* (2013.01); *F01P 2031/34* (2013.01); *F01P 2037/02* (2013.01)

(56) References Cited

U.S. PATENT DOCUMENTS

| | | | | |
|---|---|---|---|---|
| 2003/0019442 | A1* | 1/2003 | Yoshikawa | F01P 7/167 123/41.1 |
| 2012/0106590 | A1* | 5/2012 | Suzuki | F01P 11/16 374/1 |
| 2013/0255605 | A1* | 10/2013 | Jentz | F01P 11/16 123/41.15 |
| 2019/0032541 | A1* | 1/2019 | Kaneta | F02M 26/00 |
| 2021/0355857 | A1* | 11/2021 | Zeng | F01P 11/14 |

FOREIGN PATENT DOCUMENTS

| | | | |
|---|---|---|---|
| CN | 106837506 | A | 6/2017 |
| CN | 106870100 | A | 6/2017 |
| CN | 109611190 | A | 4/2019 |
| JP | H05-215000 | A | 8/1993 |
| JP | H05215000 | A | 8/1993 |
| JP | 2013060819 | A | 4/2013 |
| WO | 2021254165 | A1 | 12/2021 |

OTHER PUBLICATIONS

First Office Action issued to Foreign Counterpart Patent Application No. 202010559771.X.

* cited by examiner

WARM-UP METHOD BASED ON TEMPERATURE CONTROL MODULE, VEHICLE, AND STORAGE MEDIUM

CROSS-REFERENCE TO RELATED APPLICATIONS

This application is the 371 application of PCT Application No. PCT/CN2021/098213, filed on Jun. 3, 2021, which is based upon and claims priority to Chinese Patent Application No. 202010559771.X, filed Jun. 18, 2020, the entire contents of which are incorporated herein by reference.

TECHNICAL FIELD

The present application relates to the field of vehicle water cooling technologies, and more particularly, to a warm-up method based on a temperature control module, a vehicle, and a computer-readable storage medium.

BACKGROUND

At present, an engine cooling system, commonly used on the market usually, includes a mechanical water pump and a thermostat. A physical structure of the thermostat is mainly based on a wax pack. The wax pack is solid in a low water temperature, so a thermostat valve closes a branch through which the coolant flows to a radiator under an action of a spring. When the wax pack melts into liquid in a high water temperature, the volume increases accordingly, pushing the thermostat valve to open the branch leading to radiator to cool down. This structure determines that the engine cooling system can only be switched in two states of a large circulation (with a participation of the radiator) and a small circulation (without the participation of the radiator).

In recent years, there has also been a scheme of using a mechanical water pump and an electronic thermostat. The water temperature can be adjusted to a certain extent when the vehicle is running normally, but its warm-up process is no different from the traditional thermostat scheme.

In addition, in recent years, there has further been a quick warm-up scheme using a clutch-type water pump or a switch valve. For the scheme using the clutch-type water pump, a clutch is disconnected during a warm-up phase, so that a water pump loses power and a circulation of the coolant is stopped. For the scheme using the switch valve, an additional valve is added in the small cycle, and the small cycle is forcibly closed during the warm-up phase, so as to stop the flow of coolant. These two methods essentially stop a heat exchange process from an inside of the engine to outside, and rapidly increase a temperature of an engine cylinder wall through heat accumulation, thereby accelerating an overall temperature rise. However, both schemes have certain defects.

A clutch is added between a pulley of the engine and the water pump in the clutch-type water pump, which increases a complexity of the system. In the process of long-term use, the engagement of the clutch causes wear between the gears, and there is a higher risk in the mechanical structure. In addition, this scheme usually only uses a simple control form, which can only realize a turn-on and turn-off function. There is no intermediate change process, failing to perform a stepless adjustment.

A structure of the switch valve is simpler than that of the clutch type water pump, but it also only can realize the turn-on and turn-off function. There is no intermediate change process, failing to perform the stepless adjustment.

For the above problems, those skilled in the art have been seeking schemes.

The preceding statements are intended to provide general background information and may not constitute the prior art.

SUMMARY

There are provided a warm-up method based on a temperature control module, a vehicle, and a computer-readable storage medium according to embodiments of the present disclosure. The technical solution is as below:

According to a first aspect of embodiments of the present disclosure, there is provided a warm-up method based on a temperature control module, comprising:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value; and returning to the step of obtaining the current temperature control parameters to enter a next cycle, when an updated current water temperature value does not exceed a warm-up threshold.

According to a second aspect of embodiments of the present disclosure, there is provided a vehicle, comprising:

a memory; and a processor;

wherein the processor is configured to execute computer instructions stored in the memory, to implement following steps of the above-mentioned warm-up method based on the temperature control module:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value; and returning to the step of obtaining the current temperature control parameters to enter a next cycle, when an updated current water temperature value does not exceed a warm-up threshold.

According to a third aspect of embodiments of the present disclosure, there is provided a computer-readable storage medium, having stored therein computer-readable instructions, wherein when the computer instructions are executed by a processor, following steps of the above-mentioned warm-up method based on the temperature control module:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value; and returning to the step of obtaining the current temperature control parameters to enter a next cycle, when an updated current water temperature value does not exceed a warm-up threshold.

DETAILED DESCRIPTION

In order to make the object, technical solutions and advantages of the present application more clear, the present application will be described in further detail below with reference to the accompanying drawings and embodiments. It should be understood that the described embodiments are only a part of the embodiments of the present application, but not all of the embodiments. Based on the embodiments in the present application, all other embodiments obtained by those of ordinary skill in the art without creative efforts shall fall within the protection scope of the present application.

Figure 5:
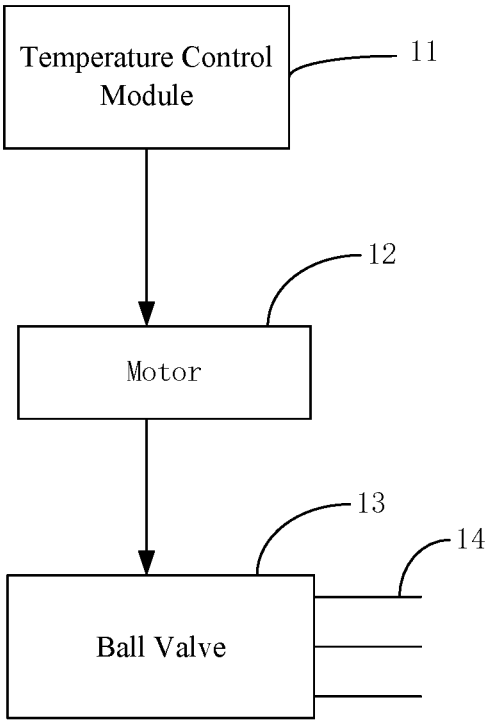
FIG. 5 illustrates a temperature control module of a vehicle control module controlling a motor to drive a ball valve according to an embodiment of the present application.

Referring to FIG. 5, a temperature control module 11 may be a newly developed component. A ball valve 13 is driven by a motor 12. When an opening of the ball valve 13 is aligned with a corresponding pipeline, a corresponding branch 14 is opened. When the opening of the ball valve 13 and the corresponding pipeline are staggered, the branch 13 may be closed, or in a half-open and half-closed state. The temperature control module 11 can control flows of 3 to 5 branches 14 at the same time, and distribute flows to branches 14, such as a large circulation, a small circulation, a warm air, an oil cooler, as needed. Since the flows are adjusted by the motor drive, an opening degree may be actively adjusted at any time, thereby solving the problem that the design of the traditional thermostat is solidified. In addition, since there is no process of melting a wax pack, an adjustment speed is extremely fast, a speed of response to the water temperature can be improved, and an adjustment of the water temperature is more accurate. Moreover, it can also be used during a normal driving, making the engine operate at an optimal temperature at any time, but not limited to an acceleration warm-up stage, having a wide range of application scenarios. The embodiments of the present application will be described in further detail below with reference to the accompanying drawings.

Embodiment 1

Figure 1:
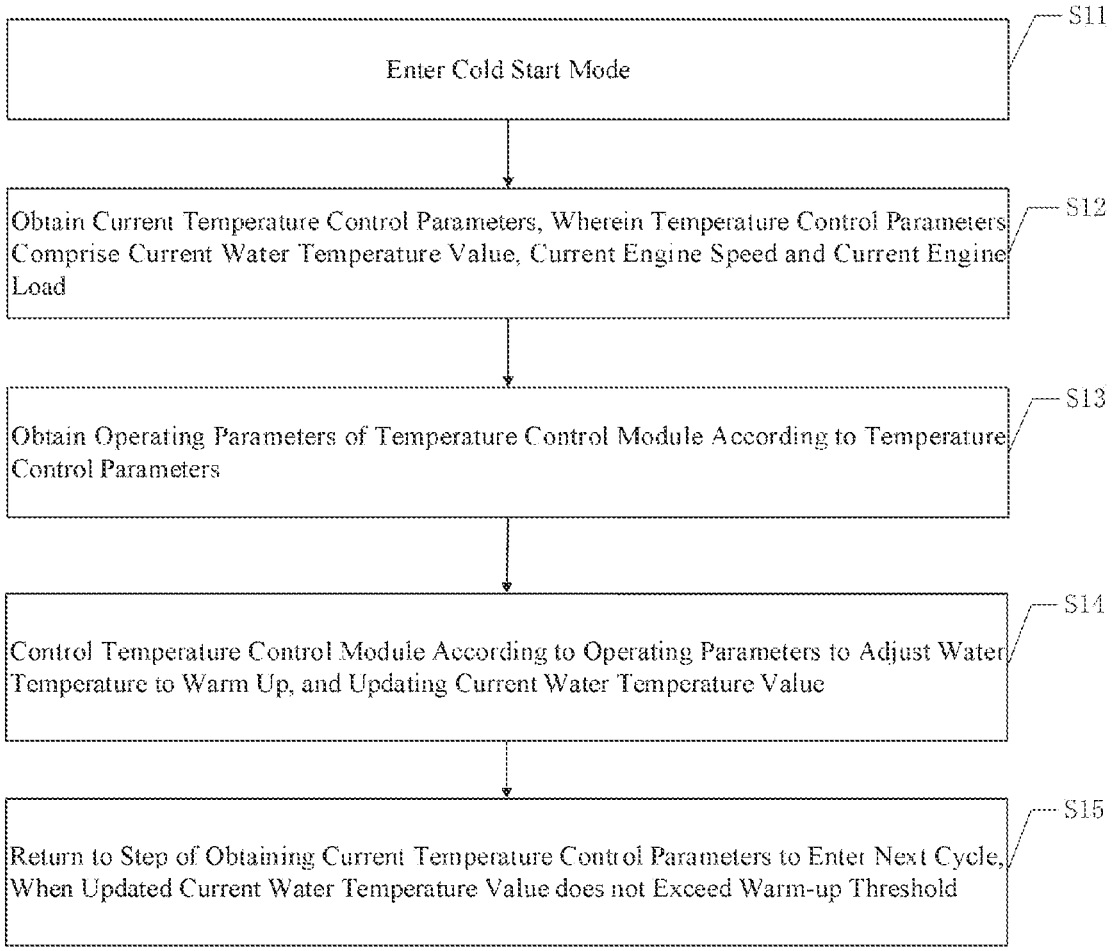
FIG. 1 illustrates a first flowchart of a warm-up method based on a temperature control module according to a first embodiment of the present application.
Figure 2:
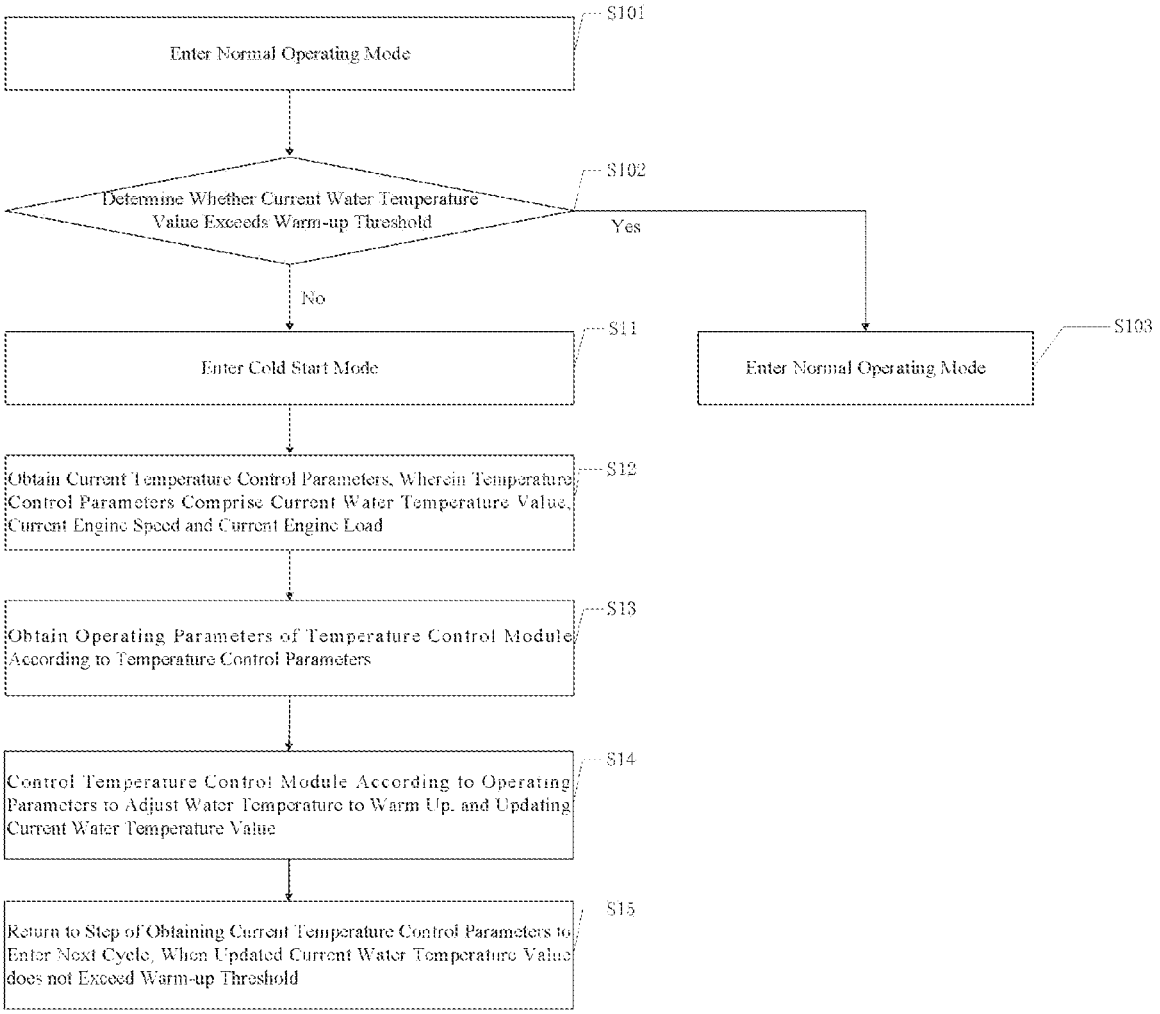
FIG. 2 illustrates a second flowchart of the warm-up method based on the temperature control module according to the first embodiment of the present application.
Figure 3:
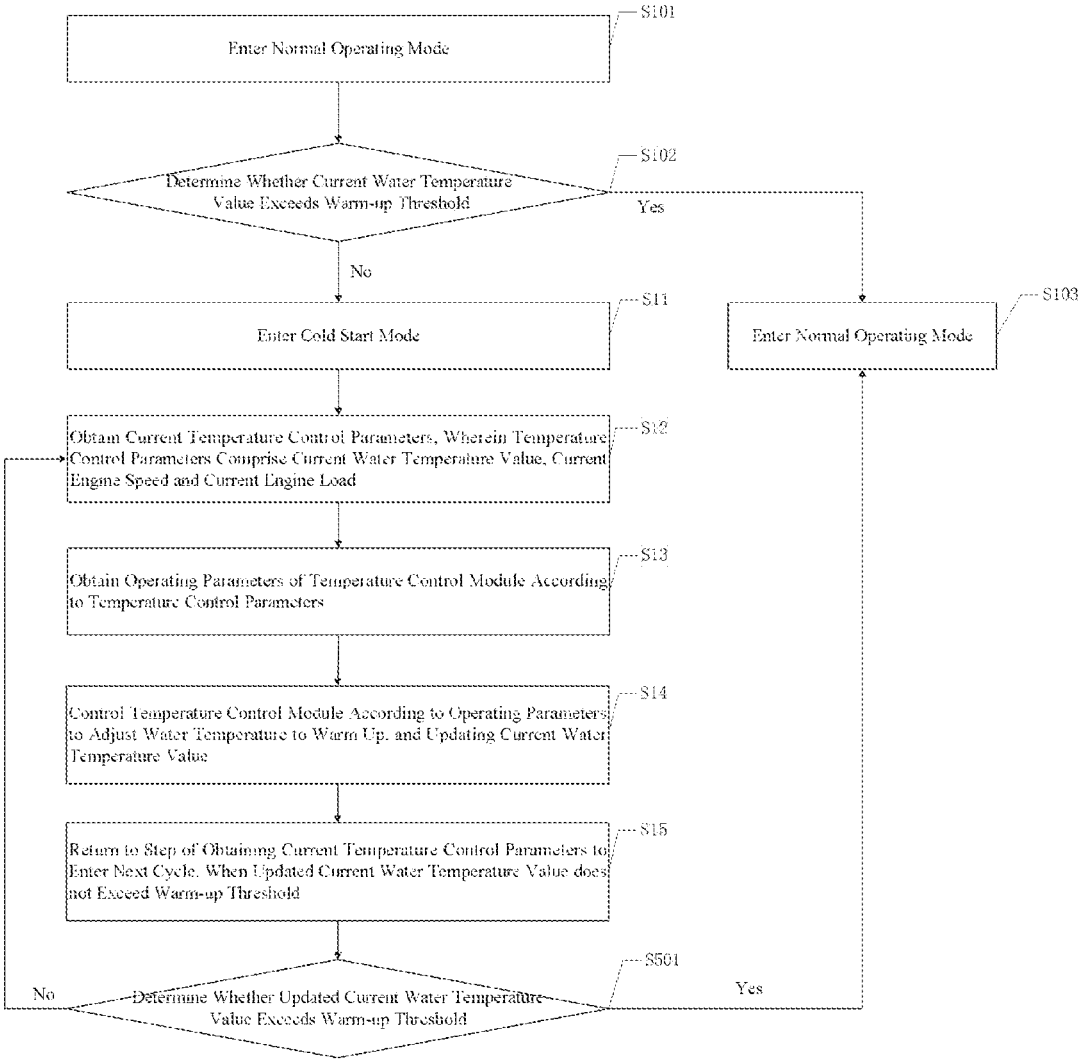
FIG. 3 illustrates a third flowchart of the warm-up method based on the temperature control module according to the first embodiment of the present application.

FIG. 1 illustrates a first flowchart of a warm-up method based on a temperature control module according to the first embodiment of the present application. FIG. 2 illustrates a second flowchart of the warm-up method based on the temperature control module according to the first embodiment of the present application. FIG. 3 illustrates a third flowchart of the warm-up method based on the temperature control module according to the first embodiment of the present application. In order to clearly describe the warm-up method based on the temperature control module according to the first embodiment of the present application, please refer to FIGS. 1-3.

The warm-up method based on the temperature control module according to the first embodiment of the present application includes the following steps.

S11: a cold start mode is entered.

Referring to FIG. 2, in one embodiment, step S11: entering the cold start mode, may include but is not limited to the following step. S101: a current water temperature value is obtained after a vehicle is powered on. S102: whether the current water temperature value exceeds a warm-up threshold is determined. S103: if yes, a normal operating mode is entered (or a hot start mode). S104: if not, the cold start mode is entered (so that the temperature control module is prepared for subsequent intermittent operation). For example, an Electronic Control Unit (ECU) acquires the current water temperature value and performs a determination based on the warm-up threshold. When the current water temperature value is higher than the warm-up threshold, it is considered to be a hot start process, and the temperature control module enters a normal operating mode. When the current water temperature is lower than the warm-up threshold, it is considered to be a cold start process, the ECU controls the temperature control module to enter the cold start mode.

In one embodiment, the current water temperature value may be acquired by a water temperature sensor.

In one embodiment, the warm-up threshold is a preset value. This value is set by referring to an opening temperature value of the thermostat in the prior art and determined in combination with an actual test effect. For example, the determined warm-up threshold generally may be set in a range of 83° C.~93° C.

In one embodiment, the cold start mode is entered so that the temperature control module is prepared for subsequent intermittent operation. For example, in the cold start operate mode, the ECU controls the temperature control module to enable the temperature control module to perform an intermittent operation through temperature control. The temperature control module is controlled by temperature control parameters to operate at a certain flow ratio (that is, corresponding to a position of a ball valve), and operates according to the calculated ON duration and OFF duration. The ON duration and the OFF duration will also be adjusted owing to the changing operating conditions and the changing water temperatures during the normal driving process after the vehicle is started.

In one embodiment, after the vehicle is powered on, the step of obtaining the current water temperature value includes the following steps. Whether the water temperature sensor is faulty is determined after the vehicle is powered on. If yes, a prompt operation and a temperature control protection operation are performed. If not, the current water temperature value is obtained by the water temperature sensor. For example, every time the ECU is powered on, the ECU starts to obtain the sensing signal (e.g., including a water temperature value of the engine and/or a fault signal) of the water temperature sensor, and whether the water temperature sensor is faulty is determined according to the sensing signal. when the water temperature sensor is faulty (e.g., the water temperature value of the engine is unreasonable, the water temperature sensor has at least one of the maximum failure and the minimum failure), the ECU cannot determine an actual water temperature of the engine, then an alarm is performed and the position of the ball valve of the temperature control module is opened to the 100% position (i.e., fully open, and the water pump flow ratio is kept at the highest value), to maintain the normal heat dissipation function and ensure that the engine does not overheat.

In one embodiment, the water temperature sensor may be arranged at a water outlet of the engine, and the water temperature sensor is connected to the ECU so that the ECU can collect the water temperature value of the engine.

In other embodiment, the warm-up method based on the temperature control module provided in this embodiment may also include, but is not limited to the following steps. Whether the water temperature sensor is faulty is detected in real time. When it is detected that the water temperature sensor is faulty, a prompt operation and a temperature control protection are performed. Therefore, the warm-up method based on the temperature control module provided in this embodiment can realize a self-diagnosis and a temperature control protection.

S12: the current temperature control parameters are obtained. The temperature control parameters include the current water temperature value, a current engine speed, and a current engine load.

In one embodiment, it should be understood that the temperature control parameters may include, but are not limited to, the current water temperature value, the current engine speed, the current engine load. For example, it may also include at least one of a water temperature range in the current water temperature value is located, and a required heat dissipation ratio, a flow ratio value corresponding to the current engine speed and current engine load, a water pump flow rate, a fan status, a current vehicle speed, a duration distribution coefficient corresponding to current engine load, an OFF duration limit value corresponding to the current engine load, and a temperature rise limit value range corresponding to the current water temperature value.

In one embodiment, according to the actual situation, the water temperature in the warm-up phase may be divided into multiple water temperature ranges, such as three water temperature ranges, four water temperature ranges and five water temperature ranges. The three water temperature ranges are taken as an example. A low water temperature range is 20-75° C. (a temperature of the low water temperature range is still relatively low, which can reduce the heat dissipation, make the water temperature continue to rise, and achieve a radical temperature rise speed without a risk). A medium water temperature range is 75-85° C. (the temperature rise needs to be appropriately slowed down. Otherwise, there may be local boiling in the cylinder). The high water temperature range is 85-90° C. (in the high water temperature range, the cold start mode may be ready to exit at any time to enter a normal operating mode). Therefore, in this embodiment, the corresponding water temperature range can be found according to the current water temperature value.

In one embodiment, comparison information (e.g., a comparison table, a MAP) between each divided water temperature range and the required heat dissipation ratio may be stored in advance. For example, the required heat dissipation ratio corresponding to the low water temperature range is 10%. The required heat dissipation ratio corresponding to the medium water temperature range is 50%. The required heat dissipation ratio corresponding to the high water temperature range is 90%.

In one embodiment, a flow rate proportional value corresponding to the current engine speed and the current engine load may be obtained, but not limited to, by searching a pre-stored relationship table. The flow rate proportional value is corresponding to an opening degree of the ball valve of the temperature control module.

In one embodiment, the duration distribution coefficient corresponding to the current engine load, and the OFF duration limit value corresponding to the current engine load may be obtained by looking up a preset MAP.

In one embodiment, the temperature rise limit value range corresponding to the current water temperature value may also be obtained by looking up the preset MAP. There are basic principles formulated by the MAP. For example, a range between an upper limit value and a lower limit value of the temperature rise limit value range is generally within a range of −3~3° C. The higher the current water temperature value is, the smaller the corresponding upper limit value and lower limit value of the temperature rise limit value range are (that is, the smaller the range between the upper limit value and the lower limit value is).

S13: the operating parameters of the temperature control module are obtained according to the temperature control parameters.

In one embodiment, step S13: obtaining the operating parameters of the temperature control module according to the temperature control parameters, may includes but is not limited to the following steps. The calculation parameters of the operating parameters are obtained according to the temperature control parameters. The calculation parameters include the required heat dissipation, the heat dissipation power and the duration distribution coefficient. The ON duration of the temperature control module is calculated according to the required heat dissipation and the heat dissipation power, and the OFF duration of the temperature control module is calculated according to the ON duration and the distribution coefficient, so as to obtain the operating parameters of the temperature control module.

In one embodiment, a calculation formula of the ON duration is: $t_{on}=Q_{need}/Pwp$. $t_{on}$ represents the ON duration, $Q_{need}$ represents the required heat dissipation, and Pwp represents the heat dissipation power.

In one embodiment, a calculation formula of the OFF duration is: $t_{off}=\varepsilon t_{on}$, wherein $t_{off}$ represents the OFF duration, and E represents the duration distribution coefficient.

In one embodiment, $t_{off}$ is proportional to $t_{on}$, and the proportional value is the duration distribution coefficient ε. When the engine load is high, the $t_{off}$ is allowed to be shorter, and the proportional value is smaller. When the engine load is low, the $t_{off}$ is allowed to be longer, and the proportional value is larger. The Map between the duration distribution coefficient ε and the engine load is formulated according to the above principles, which is provided to the ECU for table lookup.

In one embodiment, the step of obtaining the calculation parameters of the operating parameters according to the temperature control parameters may include, but is not limited to the following steps. The theoretical heat dissipation power Pwp' is obtained according to the water pump flow rate, the flow rate ratio value and the fan state (for example, the theoretical heat dissipation power Pwp' is obtained by looking up the table according to the water pump flow rate, the flow rate ratio value and the fan state). A correction operation is performed on the theoretical heat dissipation power Pwp' according to the current vehicle speed of the temperature control parameters to obtain the heat dissipation power Pwp.

In one embodiment, the water pump flow rate is strongly related to the current engine speed, and the required heat dissipation ratio set by the temperature control module may be obtained by looking up the table. In this circumstance, the flow rate of the temperature control module is $q=q_{cur}*P_{target}$ ($q_{cur}$ represents the water pump flow rate, $P_{target}$ represents the required heat dissipation ratio), the heat dissipation of the engine may be calculated according to the flow rate. However, this part of the heat needs to be exchanged through the air to be truly dissipated. In this circumstance, a heat dissipation at a radiator end may be calculated as $Q_{out}=cq\Delta T$. c is a cooling specific heat capacity, and $\Delta T$ is the temperature difference between water in an inlet of the radiator and water in an outlet water of the radiator. $\Delta T$ is actually depended on the heat dissipation power of the radiator, which is essentially determined by the output power of the fan, but also affected by the current vehicle speed. Therefore, the heat dissipation is Pwp'=f(q,s), where s is the state of the fan, and the heat dissipation Pwp' is corrected by the vehicle speed to the real heat dissipation Pwp.

In one embodiment, the step of obtaining the calculation parameters of the operating parameters according to the temperature control parameter may include, but is not limited to the following steps. The calorific value is calculated according to the current engine speed and the current engine load of the temperature control parameters. The corresponding water temperature range is obtained according to the current water temperature value of the temperature control parameters, so as to obtain the required heat dissipation ratio according to the water temperature range. The required heat dissipation is calculated according to the calorific value and the required heat dissipation ratio.

In one embodiment, the heat of the engine is carried out by the coolant, and the heat generated inside the engine may be calculated by a preset function as $Q_{in}=f(n,b)$, where n is the current engine speed, and b is the current engine load. Specifically, combined with the water pump flow and the opening degree of the ball valve of the temperature control module (corresponding to the required heat dissipation ratio), the engine can exchange a part of the calorific value to the air during its ON duration $t_{on}$ in each operating cycle, based on the calorific value $Q_{in}=f(n,b)$ inside the engine.

In one embodiment, a calculation formula of the required heat dissipation is $Q_{need}=pQ_{in}$. $Q_{need}$ represents the required heat dissipation, and p represents the required heat dissipation ratio.

In one embodiment, the step of obtaining the operating parameters of the temperature control module may include, but is not limited to the following steps. Whether the OFF duration is greater than the OFF duration limit value of the temperature control parameters is determined. If yes, the ON duration and the OFF duration limit value are taken as operating parameters. If not, the ON duration and the OFF duration are taken as operating parameters.

In one embodiment, specifically, since an excessively long OFF duration will cause a certain cooling risk, it is necessary to set the OFF duration limit value $L_t$. The greater the current engine load is, the smaller the obtained OFF duration limit value $L_t$ is. Therefore, The Map is made from the OFF duration limit value $L_t$ and the engine load according to this principle.

S14: the temperature control module is controlled according to the operating parameters to adjust the water temperature to warm up, and the current water temperature value is updated.

In one embodiment, the operating parameters may also include, but are not limited to gear control information of the ball valve of the temperature control module corresponding to the current water temperature value or the current water temperature range. step S14: controlling the temperature control module to adjust the water temperature to warm up according to the operating parameters and updating the current water temperature value, may include but is not limited to the following steps. The temperature control module is controlled according to the gear control information, the ON duration, the OFF duration and the OFF duration limit value to adjust the water temperature to warm up, and the current water temperature value is updated.

S15: when the updated current water temperature value does not exceed the warm-up threshold, return to the step S12 of obtaining the current temperature control parameters are obtained to enter the next cycle. For example, when the updated current water temperature value does not exceed the warm-up threshold, the current temperature control information is re-obtained, the operating parameters of the temperature control module are re-obtained according to the re-obtained temperature control information. The temperature control module is re-controlled according to the re-obtained operating parameters, so as to adjust the water temperature again to warm up, and the current water temperature value is updated again. Whether the updated water temperature value exceeds the warm-up threshold is determined again, and the next cycle is entered when the updated water temperature value does not exceed the warm-up threshold, and the cycles are performed in turn until the updated water temperature value exceeds the warm-up threshold.

In one embodiment, the step S15: returning to the step of obtaining the current temperature control parameters to enter the next cycle when the updated current water temperature value does not exceed the warm-up threshold, may include but is not limited to the following steps. S501: whether the updated water temperature value exceeds the warm-up threshold is determined. If not, return to step S12: the current temperature control parameters are obtained (to enter the next cycle). If yes, enter step S103: the normal operating mode is entered.

In one embodiment, specifically, the warm-up method based on the temperature control module provided in this embodiment can cyclically control the temperature control module to operate intermittently according to the change of the water temperature value, and the state that the temperature control module operates intermittently in each cycle also changes gradually according to a gradual increase of the water temperature value. Therefore, this embodiment can realize a stepless adjustment of the temperature control module, so as to fully and reasonably warm up the engine by a thermal energy of the engine with the controllable warm-up time. Moreover, since the engine water temperature is used as the warm-up trigger condition, the warm-up method based on the temperature control module provided by this embodiment has a faster response than the warm-up method based on the thermostat in the prior art.

In one embodiment, step S15: returning to the step of obtaining the current temperature control parameters to enter the next cycle when the updated current water temperature value does not exceed the warm-up threshold, may include, but is not limited to the following steps. An actual temperature rise value is obtained according to the current water temperature value and the updated current water temperature value, and the temperature rise limit value range corresponding to the current water temperature value is obtained. When the actual temperature rise value is not within the temperature rise limit value range, a correction operation is performed on the operating parameters obtained in the next cycle according to a preset correction rule.

In one embodiment, when the actual temperature rise value is not within the temperature rise limit value range, the correction operation is performed on the operating parameters obtained in the next cycle according to the preset correction rule. For example, if the actual temperature rise value is lower than a lower limit value of the temperature rise limit value range, or higher than an upper limit value of the temperature rise limit value range, the ON duration and the OFF duration obtained in the next cycle are adjusted according to the correction coefficients $\alpha$ and $\beta$.

In one embodiment, if the actual temperature rise value is within the temperature rise limit value range, the ON duration and OFF duration of the next cycle are set based on the values calculated in the current cycle. If the actual temperature rise value is lower than the lower limit value of the temperature rise limit value range, that is, the pump flow is too large and the water temperature drops too much, then the ON duration calculated in the next cycle is shortened by the correction coefficient $\alpha$, and the OFF duration calculated in the next cycle is extended by the correction coefficient $\beta$. The OFF duration calculated in the next cycle is compared with the OFF duration limit value. If the actual temperature rise value is higher than the upper limit of the temperature rise limit value range, that is, the water temperature rises too much and the pump flow is insufficient, then the ON duration calculated in the next cycle is extended by the correction coefficient $\alpha$, and the OFF duration calculated in the next cycle is shortened by the correction coefficient $\beta$. The OFF duration calculated in the next cycle is compared with the OFF duration limit value. A relationship between the correction coefficient $\alpha$ and the correction coefficient 13 may be determined directly by a function, or may be set directly through the Map. A basic principle of the relationship is: the larger the actual temperature rise value is, the more the ON duration is increased by the correction coefficient $\alpha$, and the more the OFF duration is decreased by the correction coefficient $\beta$. The smaller the actual temperature rise value is, the more the ON duration is decreased by the correction coefficient $\alpha$, and the more the OFF duration is increased by the correction coefficient $\beta$.

In one embodiment, specifically, the warm-up method based on the temperature control module provided in this embodiment can detect the actual temperature rise value, and perform the correction operation on the operating parameters obtained in the next cycle according to the relationship between the actual temperature rise value and the temperature rise limit value range. Therefore, the feedback of operating information can be realized, and the self-diagnosis can be carried out according to the feedback of the operating information, and the operating parameters of the temperature control module are corrected when the diagnosis result meets the adjustment conditions, thereby solving shortcomings in the traditional art (For example, the clutch-type water pump can only perform a simple form control in operation. It can only realize a turn-on and turn-off function, and fails to perform an operating information feedback, a self-diagnosis and an operating parameter correction. The switch valve can only perform a simple form control in operation. It can only realize a turn-on and turn-off function, and fails to perform the operating information feedback, the self-diagnosis and the operating parameter correction).

In one embodiment, the warm-up method, based on the temperature control module provided in the first embodiment of the present application, may further include, but is not limited to the water temperature information, which includes the current water temperature value and/or the temperature rise speed. When the water temperature information meets a preset cooling fault condition, it is determined that the cooling system is faulty, and a protection control operation is performed to make the engine torque limit and/or the vehicle enter a limp state.

In one embodiment, the step of monitoring the water temperature information may include, but is not limited to that the water temperature information is detected according to a preset period.

In one embodiment, it should be understood that the water temperature information may include, but is not limited to the current water temperature value and/or the temperature rise speed.

In one embodiment, the water temperature information satisfying the preset cooling fault conditions may include, but is not limited to: the current water temperature value exceeds a first fault water temperature limit value; the temperature rise speed exceeds the temperature rise speed limit value, and the current water temperature value exceeds a second fault water temperature value (the first fault water temperature value and the second fault water temperature value may be the same or different). Specifically, for example, once the ECU detects that the current water temperature value of the water temperature information exceeds the first fault water temperature limit (e.g., 120° C.), it determines that the cooling system is faulty. Alternatively, the ECU detects the water temperature change in the preset period, so as to obtain the temperature rise speed of the water temperature information. When the temperature rise speed exceeds the temperature rise speed limit value (e.g., 5° C./s), and the current water temperature value of the water temperature information exceeds the second fault water temperature limit (e.g., 105° C.), it is determined that the cooling system is faulty. Thus, after determining that the cooling system is faulty, the engine is controlled to limit torque and/or the vehicle is controlled into the limp state.

In one embodiment, when the water temperature information satisfies the preset cooling fault condition, it is determined that the cooling system is faulty, and a protection control operation is performed. The preset cooling fault condition may be a water temperature range corresponding to the current water temperature value. Therefore, this embodiment can limit the temperature rise speed of each water temperature range. In each water temperature range, when the temperature rise speed exceeds the temperature rise speed limit value corresponding to the water temperature range, whether there is a cooling system faulty in the water temperature range can be determined.

The warm-up method based on the temperature control module provided by the first embodiment of the present application includes the following steps. S11: a cold start mode is entered. S12: current temperature control parameters are obtained, and the temperature control parameters include the current water temperature value, the current engine speed, and the current engine load. S13: operating parameters of the temperature control module are obtained according to the temperature control parameters. S14: the temperature control module is controlled according to the operating parameters to adjust the water temperature to warm up and the current water temperature value is updated. S15: When the updated current water temperature value does not exceed the warm-up threshold, return to the step of obtaining the current temperature control parameters to enter a next cycle. Therefore, the warm-up method based on the temperature control module provided by the first embodiment of the present application can quickly respond after entering the cold start mode to make the temperature control module operate through cycle detection and cycle control methods, so that the temperature control module can gradually perform the corresponding warm-up operation according to changes of the temperature control parameters. Therefore, the present application enables the temperature control module to realize a stepless adjustment. In addition, in the warm-up method based on the temperature control module provided by the first embodiment of the present application, there is a good matching relationship between a duration distribution of the temperature control module during the warm-up process and the engine operating conditions. After the vehicle is cold started, a state of the water pump can be adapted to the engine under any operating conditions. Moreover, the water temperature is divided into ranges, and the temperature rise speed of each water temperature range is limited, so that the control parameters can match the temperature rise speed in each stage. Furthermore, after completing a distribution of the operating duration (i.e., the ON duration and the OFF duration) of a cycle, the output can be optimized through a series of correction coefficients, so that the temperature control module can be controlled more accurately, so as to rapidly warm up to maximum extent without an overheating risk of the engine. To sum up, the warm-up method based on the temperature control module provided by the first embodiment of the present application can realize a precise control of the temperature control module, and the operating parameters are optimized and matched by themselves during the engine warm-up process, so as to maximize an ability of the variable flow water pump in the temperature control module, thereby achieving a quick warm-up for the engine without the risk of overheating.

Embodiment 2

Figure 4:
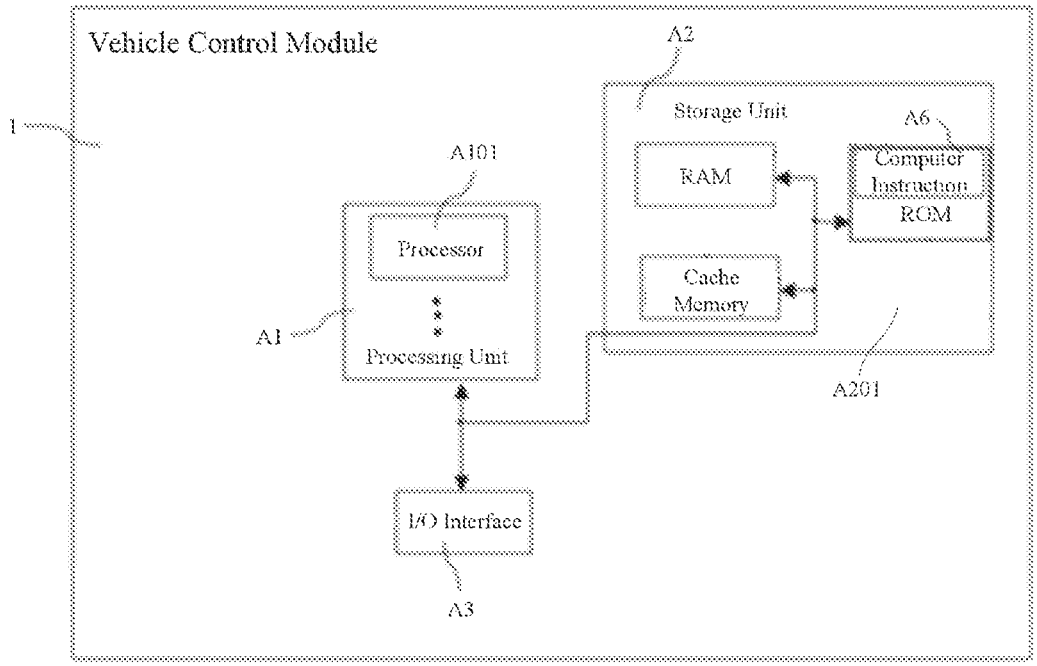
FIG. 4 illustrates a structural diagram of a vehicle control module according to a second embodiment of the present application.

FIG. 4 illustrates a structural diagram of a vehicle control module provided by a second embodiment of the present application. For a clear description of the vehicle provided by the second embodiment of the present application, please refer to FIG. 4.

The vehicle provided by the second embodiment of the present application includes a vehicle control module 1. The vehicle control module 1 includes a processor A101 and a memory A201. The processor A101 is configured to execute computer instructions A6 stored in the memory A201 to implement the steps of the temperature control module-based warm-up method described in the first embodiment.

In one embodiment, the vehicle control module 1 provided in this embodiment may include at least one processor A101 and at least one memory A201. The at least one processor A101 may be referred to as a processing unit A1, and the at least one memory A201 may be referred to as a storage unit A2. Specifically, the storage unit A2 stores the computer instructions A6. When the computer instructions A6 are executed by the processing unit A1, the vehicle control module 1 provided in this embodiment realizes the steps of the warm-up method based on the temperature control module described in the first embodiment. For example, as shown in FIG. 1, step S11: a cold start mode is entered. Step S12: current temperature control parameters are obtained, and the temperature control parameters include a current water temperature value, a current engine speed and a current engine load. Step S13: the operating parameters of the temperature control module are obtained according to the temperature control parameters. Step S14: the temperature control module is controlled according to the operating parameters to adjust the water temperature to warm up and the current water temperature value is updated. Step S15: when the updated current water temperature value does not exceed a warm-up threshold, return to the step of obtaining the current temperature control parameters to enter a next cycle.

In one embodiment, the vehicle control module 1 provided in this embodiment may include a plurality of memories A201 (referred to as storage units A2).

The storage unit A2 may be a volatile memory or a non-volatile memory, and may also include both the volatile memory and the non-volatile memory. The non-volatile memory may be Read Only Memory (ROM), Programmable ROM (PROM), Erasable Programmable ROM (EPROM), Electrically Erasable Programmable ROM (EEPROM), ferromagnetic random access memory (FRAM), Flash Memory, magnetic surface memory, optical disk, or Compact Disc Read-Only Memory (CD-ROM). The volatile memory may be Random Access Memory (RAM), which is used as an external cache memory. By way of illustration but not limitation, many forms of RAM are available, such as Static Random Access Memory (SRAM), Synchronous Static Random Access Memory (SSRAM), Dynamic Random Access Memory (DRAM), Synchronous Dynamic Random Access Memory Memory (SDRAM), Double Data Rate Synchronous Dynamic Random Access Memory (DDRSDRAM), Enhanced Synchronous Dynamic Random Access Memory (ESDRAM), SyncLink Dynamic Random Access Memory (SLDRAM), Direct Rambus Random Access Memory (DRRAM).

The storage unit A2 described in the embodiments of the present application is intended to include but not limited to these and any other suitable types of memories.

In one embodiment, the vehicle control module 1 further includes a bus connecting various components (e.g., the processor A101 and the memory A201).

In one embodiment, the vehicle control module 1 in this embodiment may further include a communication interface (e.g., I/O interface A3), which may be configured to be communicated with external devices (e.g., temperature control module, temperature sensor).

The vehicle provided in the second embodiment of the present application includes a vehicle control module 1 including a memory A101 and a processor A201. The processor A101 is configured to execute computer instructions A6 stored in the memory A201 to implement steps of the warming-up method based on the temperature control module described in the first embodiment. Therefore, the vehicle provided in this embodiment can quickly respond after entering the cold start mode to make the temperature control module operate through cycle detection and cycle control, so that the temperature control module can gradually perform a corresponding warm-up operation according to changes of the temperature control parameters. Therefore, the vehicle provided by this embodiment can make the temperature control module realize a stepless adjustment.

The second embodiment of the present application further provides a computer-readable storage medium, having stored therein computer instructions. When the computer instructions A6 are executed by the processor A101, steps of the warm-up method based on temperature control module in the first embodiment are implemented, such as steps S11-S15 shown in FIG. 1.

In one embodiment, the computer-readable storage medium provided by this embodiment may include any entity or device, recording medium capable of carrying computer instruction codes, such as ROM, RAM, magnetic disk, optical disk and flash memory.

When the computer instructions A6 stored in the computer-readable storage medium provided by the second embodiment of the present application are executed by the processor A101, the temperature control module in the vehicle can realize a stepless adjustment.

The technical features of the above-described embodiments may be combined arbitrarily. For the sake of brevity, all possible combinations of the technical features in the above-described embodiments are not described, which are, however, all should be regarded as the scope described in this specification, as long as there is no contradiction between the combinations of these technical features.

As used herein, the terms "comprise", "include" or any other variation thereof are intended to imply a non-exclusive inclusion, which not only include those elements listed, but also include other elements not expressly listed.

Described above are only specific implementations of the present application, but the protection scope of the present application is not limited herein. Any change or replacement easily made by those skilled in the art within the technical scope disclosed in the present application should fall within the protection scope of the present application. Therefore, the protection scope of the present application shall be subject to the protection scope of the claims.

INDUSTRIAL APPLICABILITY

The warm-up method based on the temperature control module, the vehicle and the computer-readable storage medium provided by the present application include the following steps. A cold start mode is entered. Current temperature control parameters are obtained, and the temperature control parameters include the current water temperature value, the current engine speed and the current engine load. Operating parameters of the temperature control module are obtained according to the temperature control parameters. The temperature control module is controlled according to the operating parameters to adjust the water temperature to warm up and the current water temperature value is updated. When the updated current water temperature value does not exceed the warm-up threshold, return to the step of obtaining the current temperature control parameters to enter a next cycle. Therefore, the present application can quickly respond after entering the cold start mode, to make the temperature control module operate through a cyclic detection and a cyclic control, so that the temperature control module can gradually perform a warm-up operation according to changes of temperature control parameters. Therefore, the present application enables the temperature control module to realize a stepless adjustment.

What is claimed is:

1. A warm-up method based on a temperature control module, comprising:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value, wherein the temperature control module is configured to control a motor to drive a ball valve to open or close, when an opening of the ball valve is aligned with a corresponding branch, the corresponding branch is opened, when the opening of the ball valve and the corresponding branch are staggered, the branch is closed, or in a half-open and half-closed state, so as to control flows of a plurality of branches, wherein the operating parameters comprise gear control information of a ball valve of the temperature control module, an ON duration, an OFF duration and an OFF duration limit value; and returning to the step of obtaining the current temperature control parameters to enter a next cycle, when an updated current water temperature value does not exceed a warm-up threshold.

2. The warm-up method based on the temperature control module of claim 1, wherein the step of entering the cold start mode comprises:

obtaining the current water temperature value after a vehicle is powered on;

determining whether the current water temperature value exceeds the warm-up threshold;

if yes, entering a normal operating mode; and if not, entering the cold start mode.

3. The warm-up method based on the temperature control module of claim 2, wherein the step of obtaining the current water temperature value after the vehicle is powered on comprises:

determining whether a water temperature sensor is faulty after the vehicle is powered on;

if yes, performing a prompt operation and a temperature control protection operation; and if not, obtaining the current water temperature value by the water temperature sensor.

4. The warm-up method based on the temperature control module of claim 1, wherein the step of obtaining the operating parameters of the temperature control module according to the temperature control parameters comprises:

obtaining calculation parameters of the operating parameters according to the temperature control parameters, wherein the calculation parameters comprises a required heat dissipation, a heat dissipation power and a duration distribution coefficient; and calculating an ON duration of the temperature control module according to the required heat dissipation and the heat dissipation power, and calculating an OFF duration of the temperature control module according to the ON duration and the distribution coefficient, so as to obtain the operating parameters of the temperature control module.

5. The warm-up method based on the temperature control module of claim 4, wherein the step of obtaining the calculation parameters of the operating parameters according to the temperature control parameters comprises:

obtaining a theoretical heat dissipation power according to a water pump flow rate, a flow rate proportional value and a fan state of the temperature control parameters; and performing a correction operation on the theoretical heat dissipation power according to a current vehicle speed of the temperature control parameters to obtain the heat dissipation power.

6. The warm-up method based on the temperature control module of claim 5, wherein the flow rate proportional value corresponding to the current engine speed and the current engine load is obtained by searching a pre-stored relationship table, and wherein the flow rate proportional value corresponds to an opening degree of the ball valve of the temperature control module.

7. The warm-up method based on the temperature control module of claim 4, wherein the step of obtaining the calculation parameters of the operating parameters according to the temperature control parameters comprises:

calculating a calorific value according to the current engine speed and the current engine load of the temperature control parameters;

obtaining a corresponding water temperature range according to the current water temperature value of the temperature control parameters, so as to obtain a required heat dissipation ratio according to the water temperature range; and calculating the required heat dissipation according to the calorific value and the required heat dissipation ratio.

8. The warm-up method based on the temperature control module of claim 4, wherein the step of obtaining the operating parameters of the temperature control module comprises:

determining whether the OFF duration is greater than an OFF duration limit value of the temperature control parameters;

if yes, taking the ON duration and the OFF duration limit value as the operating parameters; and if not, taking the ON duration and the OFF duration as the operating parameters.

9. The warm-up method based on the temperature control module of claim 1, wherein after returning to the step of obtaining the current temperature control parameters to enter the next cycle when the updated current water temperature value does not exceed the warm-up threshold, the method further comprises:

obtaining an actual temperature rise value according to the current water temperature value and the updated current water temperature value, and obtaining a temperature rise limit value range corresponding to the current water temperature value; and performing a correction operation on operating parameters obtained in the next cycle according to a preset correction rule, when the actual temperature rise value is not within the temperature rise limit value range.

10. The warm-up method based on the temperature control module of claim 1, further comprising:

monitoring water temperature information, wherein the water temperature information comprises the current water temperature value and/or a temperature rise speed; and determining that a cooling system is faulty, and performing a protection control operation to limit an engine torque and/or make a vehicle enter a limp state, when the water temperature information satisfies a preset cooling fault condition.

11. A vehicle, comprising:

a memory; and a processor;

wherein the processor is configured to execute computer instructions stored in the memory, to implement following steps of the warm-up method based on the temperature control module:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value, wherein the temperature control module is configured to control a motor to drive a ball valve to open or close, when an opening of the ball valve is aligned with a corresponding branch, the corresponding branch is opened, when the opening of the ball valve and the corresponding branch are staggered, the branch is closed, or in a half-open and half-closed state, so as to control flows of a plurality of branches, wherein the operating parameters comprise gear control information of a ball valve of the temperature control module, an ON duration, an OFF duration and an OFF duration limit value; and returning to the step of obtaining the current temperature control parameters to enter a next cycle, when an updated current water temperature value does not exceed a warm-up threshold.

12. A non-transitory computer-readable storage medium, having stored therein computer-readable instructions, wherein when the computer instructions are executed by a processor, following steps of the warm-up method based on the temperature control module are implemented:

entering a cold start mode;

obtaining current temperature control parameters, wherein the temperature control parameters comprise a current water temperature value, a current engine speed and a current engine load;

obtaining operating parameters of the temperature control module according to the temperature control parameters;

controlling the temperature control module according to the operating parameters to adjust a water temperature to warm up, and updating the current water temperature value, wherein the temperature control module is configured to control a motor to drive a ball valve to open or close, when an opening of the ball valve is aligned with a corresponding branch, the corresponding branch is opened, when the opening of the ball valve and the corresponding branch are staggered, the branch is closed, or in a half-open and half-closed state, so as to control flows of a plurality of branches, wherein the operating parameters comprise gear control information of a ball valve of the temperature control module, an ON duration, an OFF duration and an OFF duration limit value; and returning to the step of obtaining the current temperature control parameters to enter a next cycle, when an updated current water temperature value does not exceed a warm-up threshold.

13. The computer-readable storage medium of claim 12, wherein the step of entering the cold start mode comprises:

obtaining the current water temperature value after a vehicle is powered on;

determining whether the current water temperature value exceeds the warm-up threshold;

if yes, entering a normal operating mode; and if not, entering the cold start mode.

14. The computer-readable storage medium of claim 13, wherein the step of obtaining the current water temperature value after the vehicle is powered on comprises:

determining whether a water temperature sensor is faulty after the vehicle is powered on;

if yes, performing a prompt operation and a temperature control protection operation; and if not, obtaining the current water temperature value by the water temperature sensor.

15. The computer-readable storage medium of claim 12, wherein the step of obtaining the operating parameters of the temperature control module according to the temperature control parameters comprises:

obtaining calculation parameters of the operating parameters according to the temperature control parameters, wherein the calculation parameters comprises a required heat dissipation, a heat dissipation power and a duration distribution coefficient; and calculating an ON duration of the temperature control module according to the required heat dissipation and the heat dissipation power, and calculating an OFF duration of the temperature control module according to the ON duration and the distribution coefficient, so as to obtain the operating parameters of the temperature control module.

16. The computer-readable storage medium of claim 15, wherein the step of obtaining the calculation parameters of the operating parameters according to the temperature control parameters comprises:

obtaining a theoretical heat dissipation power according to a water pump flow rate, a flow rate proportional value and a fan state of the temperature control parameters; and performing a correction operation on the theoretical heat dissipation power according to a current vehicle speed of the temperature control parameters to obtain the heat dissipation power.

17. The computer-readable storage medium of claim 15, wherein the step of obtaining the calculation parameters of the operating parameters according to the temperature control parameters comprises:

calculating a calorific value according to the current engine speed and the current engine load of the temperature control parameters;

obtaining a corresponding water temperature range according to the current water temperature value of the temperature control parameters, so as to obtain a required heat dissipation ratio according to the water temperature range; and calculating the required heat dissipation according to the calorific value and the required heat dissipation ratio.

18. The computer-readable storage medium of claim 12, wherein the step of entering the cold start mode comprises:

obtaining the current water temperature value after a vehicle is powered on;

determining whether the current water temperature value exceeds the warm-up threshold;

if yes, entering a normal operating mode; and if not, entering the cold start mode.

19. The computer-readable storage medium of claim 17, wherein the step of obtaining the current water temperature value after the vehicle is powered on comprises:

determining whether a water temperature sensor is faulty after the vehicle is powered on;

if yes, performing a prompt operation and a temperature control protection operation; and if not, obtaining the current water temperature value by the water temperature sensor.

20. The computer-readable storage medium of claim 12, wherein the step of obtaining the operating parameters of the temperature control module according to the temperature control parameters comprises:

obtaining calculation parameters of the operating parameters according to the temperature control parameters, wherein the calculation parameters comprises a required heat dissipation, a heat dissipation power and a duration distribution coefficient; and calculating an ON duration of the temperature control module according to the required heat dissipation and the heat dissipation power, and calculating an OFF duration of the temperature control module according to the ON duration and the distribution coefficient, so as to obtain the operating parameters of the temperature control module.

21. The computer-readable storage medium of claim 20, wherein the step of obtaining the calculation parameters of the operating parameters according to the temperature control parameters comprises:

obtaining a theoretical heat dissipation power according to a water pump flow rate, a flow rate proportional value and a fan state of the temperature control parameters; and performing a correction operation on the theoretical heat dissipation power according to a current vehicle speed of the temperature control parameters to obtain the heat dissipation power.

* * * * *